US005152952A

United States Patent [19]

Brenczek et al.

[11] Patent Number: 5,152,952

[45] Date of Patent: Oct. 6, 1992

[54] DEVICE FOR UNCLOGGING A LANCE INTENDED TO BE INSERTED INTO A METALLURGICAL VESSEL

[75] Inventors: Stanilas Brenczek, Hayange; Elio Morganti, Avril; Roland Schneider, Moyeuvre; Jean-Pierre Masson, Aboncourt; Carlo Ottavino, Metzeresche; Jean-Claude Striebel, Guenange, all of France

[73] Assignee: Unimetal, Metz, France

[21] Appl. No.: 766,206

[22] Filed: Sep. 27, 1991

[30] Foreign Application Priority Data

Sep. 27, 1990 [FR] France ..... 90 12085

[51] Int. Cl.[5] ..... C21B 7/16; C21B 9/10

[52] U.S. Cl. ..... 266/136; 266/266; 266/270

[58] Field of Search ..... 266/136, 270, 266

[56] References Cited

U.S. PATENT DOCUMENTS 4,465,265 8/1984 Kryczun ..... 266/270

4,854,553 8/1989 Labate ..... 266/270

*Primary Examiner*—Peter D. Rosenberg

*Attorney, Agent, or Firm*—Pollock, Vande Sande & Priddy

[57] ABSTRACT

This device comprises a fixed support constituted by a cylindrical collar 14, through which the lance 5 may be axially displaced and scraping fingers 16 whose extremities, which comprise cleaving means 21, may be held substantially in contact with the lance. A clearance is arranged, between the lance and the collar, which is sufficient to allow the accretions 12 of materials which it is desired to remove from the lance to pass through. While the lance is being raised, the extremities of the fingers cleave the accretions until they are totally broken off from the lance and can then fall into the vessel.

The device is particularly applicable to the unclogging of oxygen lances used in steelworks converters.

11 Claims, 3 Drawing Sheets

DEVICE FOR UNCLOGGING A LANCE INTENDED TO BE INSERTED INTO A METALLURGICAL VESSEL

FIELD OF THE INVENTION

The present invention relates to the field of steelworks converters equipped with oxygen lances, and more particularly to the cleaning of these lances in order to strip therefrom the accretions of materials which are produced on their external surface during their use.

PRIOR ART

It is known that, during the operation of such a converter, the injection of oxygen by the lance may cause severe projections of slag or metal which adhere to the bore of the latter and clog it up. These projections may build up and form a gangue called "skull", partially or totally coating the bore of the lance. In order to prevent this skull from becoming too great and risk obstructing the raising of the lance or even damaging the guide shaft of the lance, it is necessary to clean the bore of the lance regularly.

FR-A-2,214,752 describes a device making it possible to ensure this cleaning automatically while the lance is being raised. This device is constituted by a fixed support ensuring the guiding of the lance and is provided with scraping fingers distributed around the lance.

These fingers, the lower extremity of which in contact with the lance is configured in the form of a ploughshare, serve, while the lance is being raised, to cleave and separate the skull in order to facilitate its removal from the lance. Despite this cleaving of the skull, accretions may persist in the zones of the wall of the lance which are located between two fingers and become butted up against the support which finally causes them to be torn off, but at the cost of a significant increase in the force required for raising the lance.

SUMMARY OF THE INVENTION

The object of the present invention is to reduce these forces which risk damaging the lance or the support, and which requires the components holding and driving the lance to be oversized.

With this objective in view, the subject of the invention is a device for unclogging a lance, such as a blast pipe of a steelworks converter, intended for inserting from above into a metallurgical vessel, of the type comprising a fixed support which comprises an orifice through which the lance may be axially displaced and, distributed around this orifice, scraping fingers whose extremities, which may be held substantially in contact with the external wall of the lance, comprise cleaving means set up in such a manner as to cleave materials accreted on the wall of the lance while the latter is extracted from said vessel.

According to the invention, the orifice of the support has dimensions greater than those of the cross-section of said lance, in such a manner as to leave a clearance, between the latter and the support, sufficient to allow said materials accreted on the wall of the lance to pass through freely.

According to a particular arrangement, the fixed support is surmounted by a frustoconical collar flaring upwards, in such a manner as to form a funnel.

According to yet another arrangement, the fingers are able to retract towards the periphery of the orifice.

According to yet another arrangement, the fingers retract through the openings arranged in the wall of the support, and sealing means are provided in order to prevent the passage of smoke or dust particles through these openings. These sealing means may be constituted by one or more cowlings covering these openings by the outside of the support, or by an injection of a gaseous fluid into these openings. Such an injection creates a gaseous sealing screen which does not obstruct the movement of the fingers. In addition, the jet of gas injected prevents dust particles from being deposited in the openings and on the fingers, and thus ensures freedom of movement of the latter.

The unclogging device according to the invention, because of the clearance arranged between the support and the lance, allows the accretions, cleaved but not totally broken off from the lance, to pass between the scraping fingers into the orifice of the support, thus preventing these remaining accretions from abutting against said support and thus eliminating the force which otherwise would be necessary to tear off the accretions and to follow the withdrawal of the lance. On the contrary, when, after the upward movement of the lance, these accretions are cleaved over their entire height, they become detached from the lance without difficulty.

BRIEF DESCRIPTION OF THE DRAWINGS

Other characteristics and advantages will be more apparent from the description which will be given, by way of example, of a declogging device according to the invention, for cleaning an oxygen blast pipe in a steelworks converter.

DESCRIPTION OF THE PREFERRED EMBODIMENTS

Figure 1:
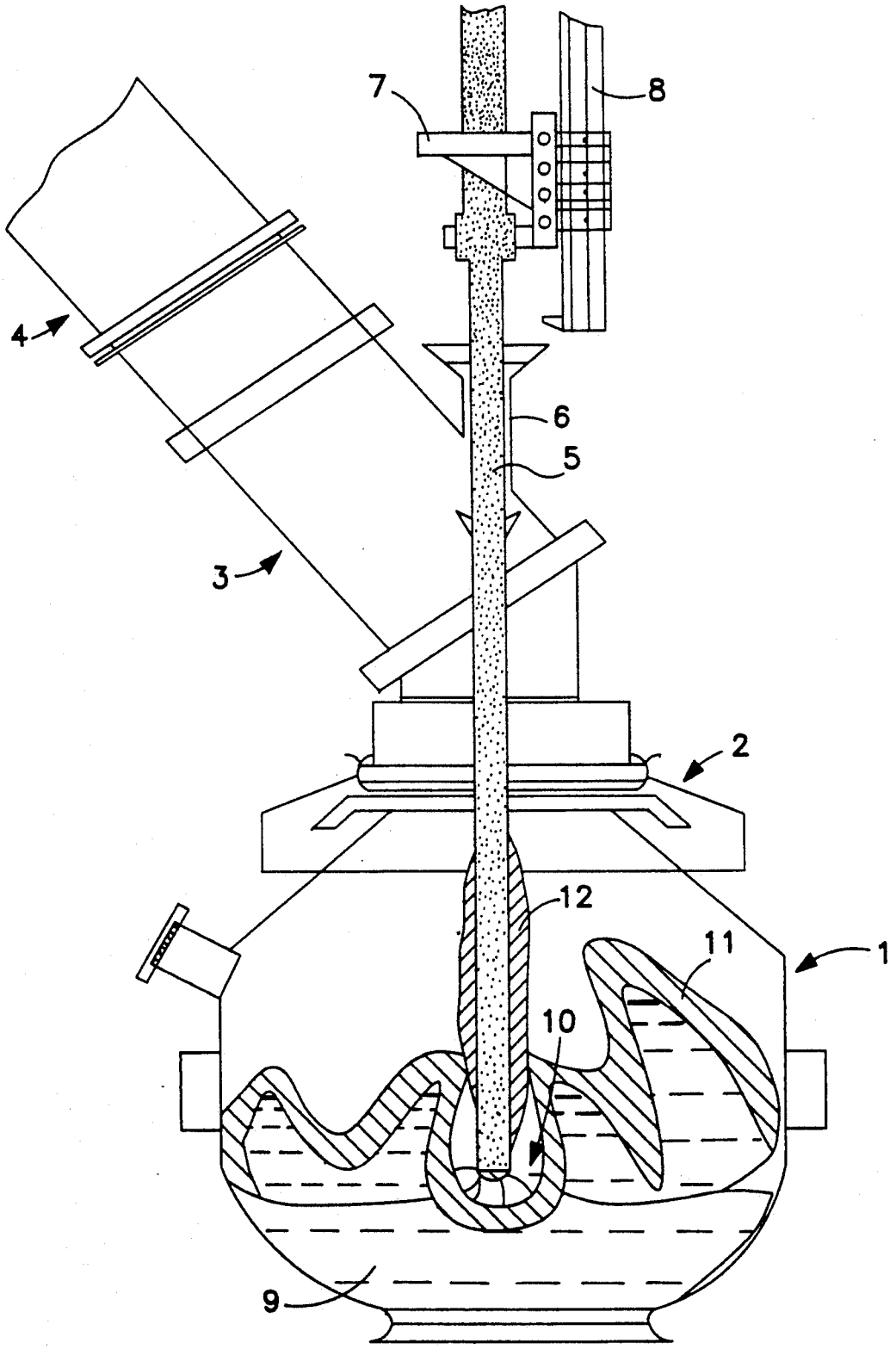
FIG. 1 is a diagrammatic view, overall, of converter, shown in the refining phase.

FIG. 1 shows a steelmaking plant comprising a converter 1 surmounted by a covering skirt 2 connected by a hood 3, for extracting fumes, to a chimney 4. A cooled blast pipe 5 penetrates substantially vertically into the converter by passing into a lance shaft 6 connected to the hood. This lance is supported by a carriage 7 which is guided by guiding slides 8 and may be displaced vertically by drive means (not shown).

The plant is shown in FIG. 1 in a refining phase of the molten steel 9 contained in the converter, the lance then being in the lower position and oxygen 10 being blasted towards the steel melt. Under the effect of this gas blast, the steel melt 9 surmounted with slag 11 is violently agitated and projections of slag and metal are deposited and accreted by solidifying on the wall of the lance where, by building up, they lead to the formation on the latter of a skull 12. This skull is therefore formed from accretions of solidified metal and slag, which may cover the lance, all around, over a significant height. The problem posed by the presence of this skull is that, if it is left to grow excessively, not only does it constitute an overload for the device for holding the lance but there is a risk of damage to the shaft of the lance or to the lance itself, while the latter is being raised, or even a risk of no longer being able to extract the lance out of the converter, due to the skull jamming into the shaft. It is necessary therefore to remove these accretions from the lance, this being carried out by the device according to the invention, which will now be described in conjunction with FIGS. 2 to 4, together with its operation.

The device is located in the plant described hereinabove, at the position of the lance shaft. The device comprises, therefore, a support constituted by a cylindrical collar 14 rigidly fixed to the lance shaft and surmounted by a funnel-shaped frustoconical collar 15. The internal diameter of the cylindrical collar is appreciably greater than that of the lance, so as to leave between them a clearance sufficient to allow the accretions 12 to pass through. For example, the diameter of the lance may be 450 mm and the external diameter of the collar 900 mm. Radial and angularly distributed scraping fingers 16 are mounted pivotably on horizontal axis pivots 17 connected to the cylindrical collar 14, in such a manner as to be able to pivot in a vertical radial plane. In one working position, shown in FIG. 2, these fingers extend substantially horizontally towards the center of the orifice defined by the cylindrical collar, virtually in contact with the lance; in other words, the length of these fingers is determined so that in this position they leave between them a free space sufficient to allow the free passage of the lance when the latter is devoid of any accretion.

The fingers 16 are fitted, in this position, with a return means, which here are counterweights 18. Moreover, an abutment 19 is provided for each finger in order to prevent it from pivoting upwards beyond their working position.

By pivoting downwards, the fingers may be retracted in such a manner as to clear the inside of the collar 14. Preferably, so as to be able to clear this space totally, the pivots 17 of the fingers are mounted in windows 20 arranged in the wall of the collar in such a way that the fingers can be entirely retracted into these windows.

At their extremities, the fingers carry cleaving means which can be constructed, for example, in the form of knives 21 whose cutting edge is directed downwards. In the working position, these knives are substantially level with the pivots of the fingers. The slight clearance 22 between the extremity of the fingers and the lance prevents marking the lance in the event the latter is slightly off-center.

The operation of the device is as follows:

When, after the blasting phase, it is desired to raise the lance, the means for driving the carriage 7 are actuated, and these displace the lance upwards. The latter passes freely between the fingers 16 which are held by the counterweights 18 in their working position, such that no accretion abuts against the extremities of said fingers.

Figure 2:
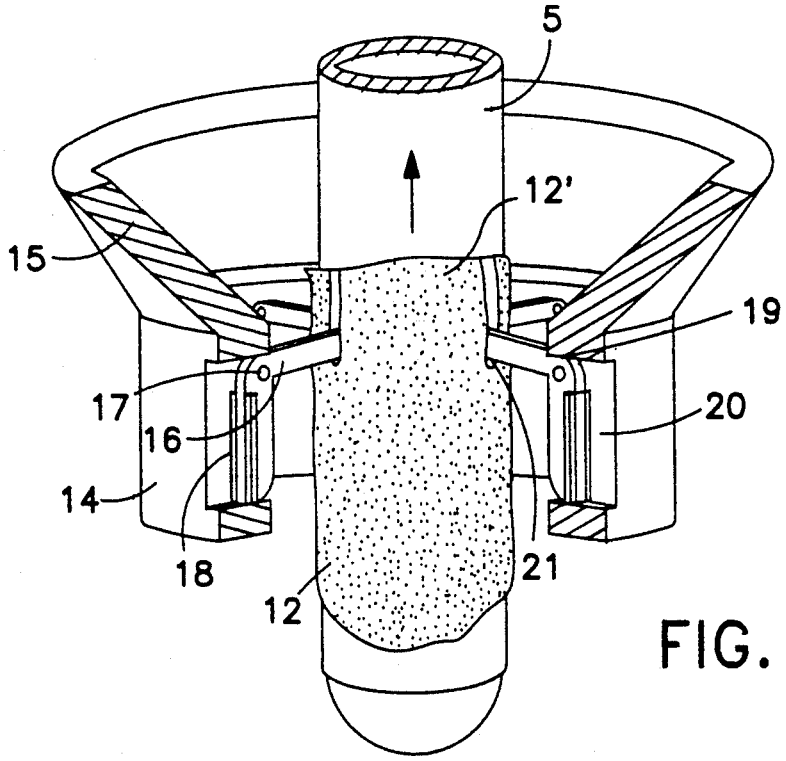
FIG. 2 is a detail view, in perspective, of the unclogging device according to the invention during a phase of raising the lance.

When the skull 12 formed by these accretions comes level with the fingers, because of the the upward movement of the lance, the knives 21 carried by the extremities of the fingers start to cleave the skull vertically, as shown in FIG. 2. This cleaving tends to cause separation of the cleaved skull portions 12' and their detachment from the lance. But these skull portions remain attached to the lower portion of the skull 12 and, although detached from the lance, they continue to accompany the latter in its movement. On the other hand, by virtue of the significant clearance between the lance and the cylindrical collar 14, they pass through freely inside the latter.

As the lance continues its upward movement, the cleaving of the skull continues as far as its lower extremity. The skull portions, which are cleaved, detached from the lance and thus no longer interconnected, become detached from the lance and drop under their own weight into the space between the lance and the collar 14, and fall into the converter. The fall of these portions is facilitated by the fact that the fingers, now no longer being subjected to the cleaving force which held them in the working position against the abutments 11, may be retracted by pivoting under the weight of the skull portions alone.

It will be noted that the frustoconical collar 15 serves advantageously as a funnel for collecting the skull portions when they become detached from the lance and directing them towards the free space of the collar.

It will be easily understood that the force for raising the lance needed to clean the lance is, by virtue of the invention, considerably reduced in relation to that which is needed for the use of the devices in the prior art, such as the one described at the beginning of this specification. Indeed, in these devices the accretions are scraped in any way over the entire periphery of the lance; this, despite the prior cleaving, leads to a considerable resistance in raising the lance. By contrast, the use of the device according to the present invention, while raising the lance, creates only the force necessary for cleaving. The device may thus be considerably lightened and, in addition, the risks of damaging the lance are reduced.

Figure 3:
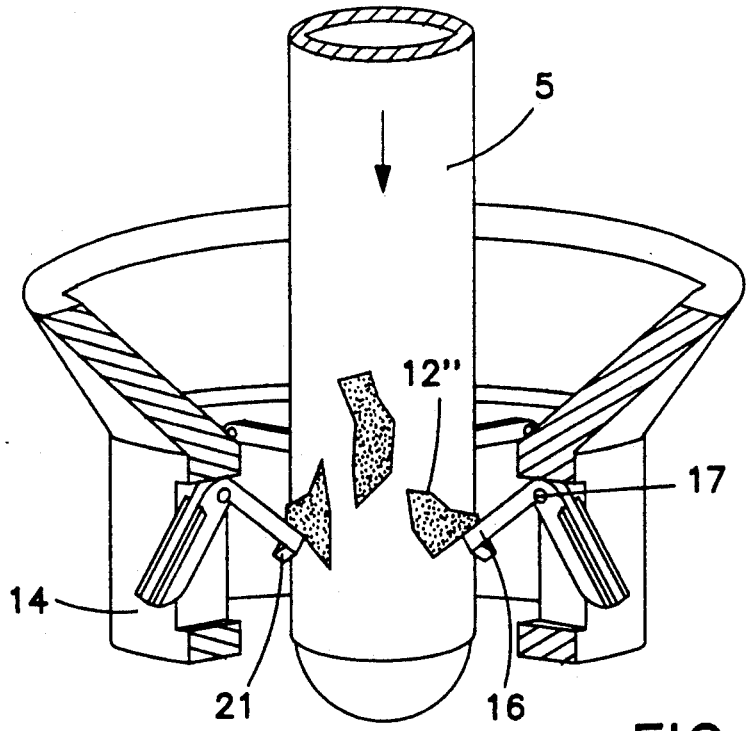
FIG. 3 is a corresponding view during the subsequent lowering of the lance.
Figure 4:
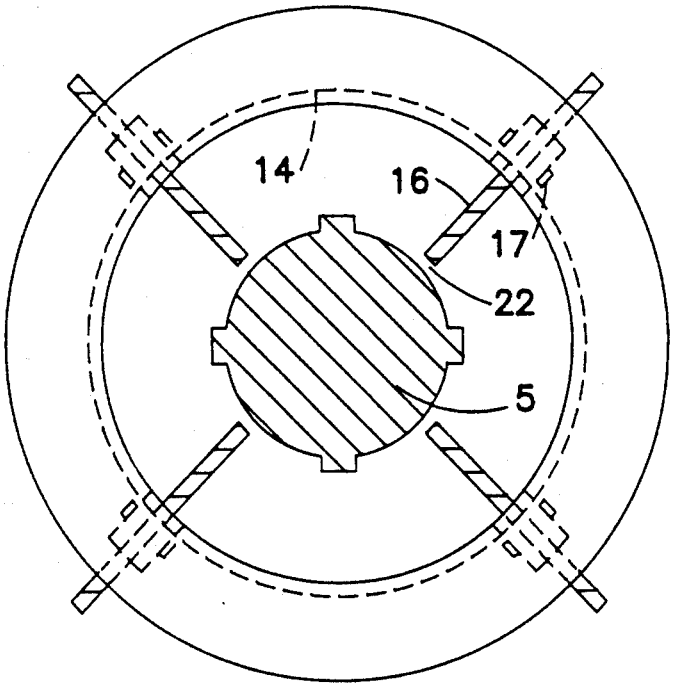
FIG. 4 is a top plan view of the device.

It will also be noted that, in the case where accretions had remained stuck to the lance after raising it, for example accretions 12'' that had passed through between the fingers of the device without being detached, the additional thicknesses thus created would not obstruct the subsequent descent of the lance, as on their passing into the device they would push the fingers back, as is shown in FIG. 3.

The invention is not limited to the particular device which has just been described solely by way of example. In particular, the scraping fingers may be mounted beneath the cylindrical collar. The counterweights may also be replaced by elastic return means, for example springs, and the abutments for the fingers may be constituted by any abutment means preventing the fingers from pivoting upwards beyond their working position. Likewise, the collar 14 may, by itself, constitute the lance shaft.

Figure 5:
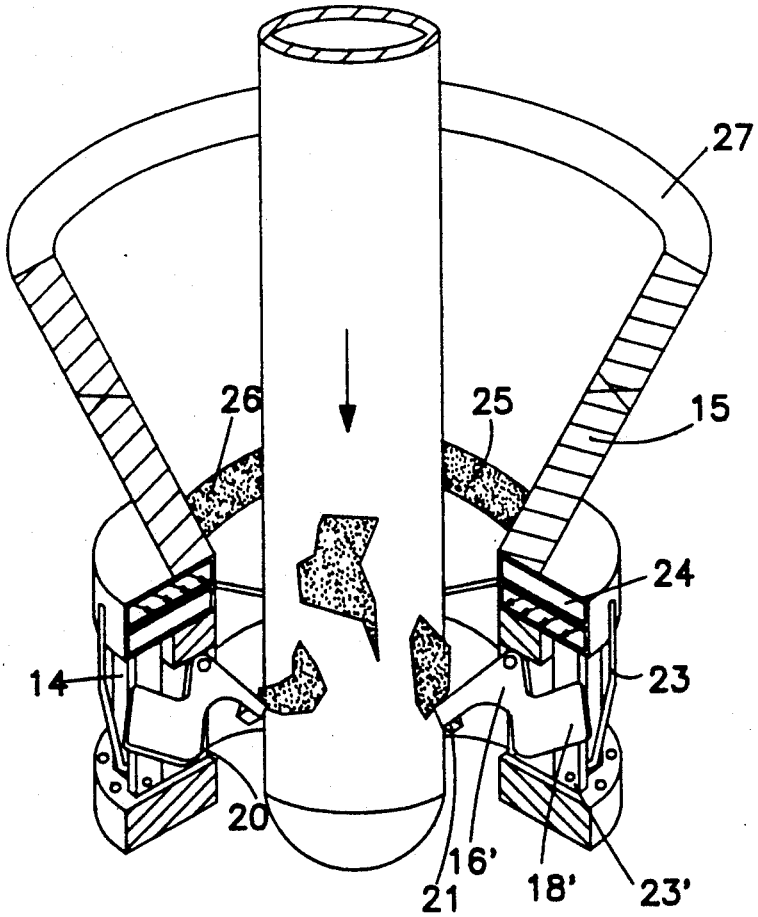
FIG. 5 is a view similar to that of FIG. 3, of a second embodiment of the device.

The shape of the fingers may also be modified. For example, in order to increase their rigidity, these may consist, as shown in FIG. 5, of plates 16' carrying the knives 21, at the corresponding location of the fingers described hereinabove, and of which a part 18', by extending outwards from the collar, constitutes the counterweight. The configuration of the fingers may be modified insofar as, on the one hand, they are not able to interfere with the lance regardless of their position and, on the other hand, their extremities carrying the knives are located in their position closest to the lance, when said fingers are in abutment, in the working position.

In the FIG. 5 embodiment, the device comprises means for sealing the windows 20, constituted by nozzle pipes 23 emerging in said windows by nozzles 23'.

These nozzle pipes are joined on hollow rings 24 surmounting the collar 14, and are connected to means (not shown) for supplying a pressurized gaseous fluid, such as steam or nitrogen. These rings have their internal wall 25 pierced by a plurality of orifices 26 by means of which the gaseous fluid escapes into the collar. Thus the gaseous fluid issuing from the orifices 26 and 23' creates a gaseous sealing screen as much between the collar and the lance as in the windows 20.

The windows 20 may also be sealed by installing cowlings (not shown) covering either each window, respectively, or the entire set of windows, these cowlings being fixed to the collar in a sealed manner and having a shape and size such that they do not obstruct the movement of the scraping fingers.

There will also be noted, in the embodiment form of FIG. 5, an extension 27 of the frustoconical collar 15, intended for facilitating the collection and the guiding of the pieces of skull detached from the lance.

We claim:

1. A device for unclogging a lane (5) inserted from above into a metallurgical vessel (1), said device comprising a fixed support (14) which comprises an orifice through which said lane is axially displaced and, distributed around said orifice, scraping fingers (16) having extremities adapted to be held substantially in contact with an outer wall of said lance, said fingers comprising means (21) for cleaving materials (12) accreted on said outer wall of said lance while said lance is extracted from said vessel, wherein said orifice of said fixed support has dimensions greater than dimensions of a cross-section of said lance, so as to leave a gap, between said lance and said fixed support, sufficient to allow said materials accreted on said outer wall of said lance to pass freely through said gap.

2. The device as claimed in claim 1, wherein said fixed support is surmounted by a frustoconical collar flaring upwards to form a funnel.

3. The device as claimed in claim 1, wherein said fingers are retractable towards a periphery of said orifice.

4. The device as claimed in claim 3, wherein said fingers are adapted to pivot about pivots (17) connected to a cylindrical collar constituting said fixed support and fitted with means (18) for returning said fingers to a working position in which said fingers extend radially towards the center of said orifice, abutments (19) preventing said fingers from pivoting upwards beyond said working position.

5. The device as claimed in claim 4, comprising windows (20) arranged in said collar (14), said pivots (17) of said fingers being mounted in said windows in such a way that said fingers may be retracted inside said windows.

6. The device as claimed in claim 1, wherein said fingers carry at their extremities cleaving means (21) having a downwardly oriented cutting edge.

7. The device as claimed in claim 5, comprising means (20) for sealing said windows.

8. The device as claimed in claim 7, wherein said sealing means comprise means (23, 23') for injecting a gaseous fluid into each window.

9. The device as claimed in claim 8, wherein said gaseous fluid is steam.

10. The device as claimed in claim 8, wherein said gaseous fluid is nitrogen.

11. The device as claimed in claim 1, wherein said lance is a blast pipe of a steelworks converter.

* * * * *